US008490214B2

(12) United States Patent
Crye

(10) Patent No.: US 8,490,214 B2
(45) Date of Patent: Jul. 23, 2013

(54) FACE ARMOR

(75) Inventor: Caleb Clark Crye, Brooklyn, NY (US)

(73) Assignee: Lineweight LLC, Brooklyn, NY (US)

( * ) Notice: Subject to any disclaimer, the term of this patent is extended or adjusted under 35 U.S.C. 154(b) by 1129 days.

(21) Appl. No.: 12/050,910

(22) Filed: Mar. 18, 2008

(65) Prior Publication Data

US 2011/0145964 A1 Jun. 23, 2011

Related U.S. Application Data

(60) Provisional application No. 60/895,654, filed on Mar. 19, 2007.

(51) Int. Cl.
*A41D 13/00* (2006.01)

(52) U.S. Cl.
USPC ..... 2/9; 2/2.5

(58) Field of Classification Search
USPC ..... 2/2.5, 6.2, 6.6, 6.7, 6.8, 411, 417, 2/418, 420, 424, 425, 173, 422, 410, 5, 15, 2/9

See application file for complete search history.

(56) References Cited

U.S. PATENT DOCUMENTS

| | | | | |
|---|---|---|---|---|
| 2,889,555 A | | 6/1959 | Stuart et al. | |
| 2,903,700 A | * | 9/1959 | Finken et al. | 2/10 |
| 3,100,896 A | | 8/1963 | Khanbegian | |
| 3,239,842 A | | 3/1966 | Marchello | |
| 3,843,970 A | | 10/1974 | Marietta et al. | |
| 4,091,469 A | | 5/1978 | Davidson | |
| 4,180,868 A | | 1/1980 | Snow | |
| 4,250,577 A | * | 2/1981 | Smith | 2/427 |
| 4,475,248 A | | 10/1984 | L'Abbe et al. | |
| 4,665,569 A | * | 5/1987 | Santini | 2/425 |
| 4,677,694 A | | 7/1987 | Crow | |
| 4,703,879 A | * | 11/1987 | Kastendieck et al. | 2/422 |
| 4,885,806 A | * | 12/1989 | Heller | 2/423 |
| 4,916,759 A | | 4/1990 | Arai | |
| 5,263,204 A | * | 11/1993 | Butsch | 2/424 |
| 5,619,755 A | * | 4/1997 | Casartelli | 2/424 |

(Continued)

FOREIGN PATENT DOCUMENTS

WO 2006037293 A1 4/2006

OTHER PUBLICATIONS

International Search Report for PCT/US2008/057384 dated Sep. 22, 2008.

(Continued)

*Primary Examiner* — Khoa Huynh
*Assistant Examiner* — Andrew W Collins
(74) *Attorney, Agent, or Firm* — Stiennon & Stiennon

(57) ABSTRACT

Ballistic material side elements are shaped to cover portions of a wearer's face and selectively attached to a ballistic helmet. The side elements cover the sides of the wearer's head, but leave room to avoid interfering with hearing needs and goggles. These side elements are held in place by connecting them to the existing helmet shell with an encircling strap and band, or to the straps and hardware of the helmet retention system by receiving portions of the straps through loops on the interior of the side elements. A front ballistic member may join the side elements to cover a significant portion of the wearer's face. The ballistic material is formed of a plurality of layers with a resin and joined by the application of pressure. Higher pressure in the forming of the side elements produces stiff members which stay in place when attached to the helmet.

21 Claims, 3 Drawing Sheets

U.S. PATENT DOCUMENTS

| | | | | |
|---|---|---|---|---|
| 5,621,923 | A * | 4/1997 | Tapocik | 2/422 |
| 6,138,284 | A | 10/2000 | Arai | |
| 6,185,753 | B1 | 2/2001 | Arai | |
| 6,282,726 | B1 | 9/2001 | Noyerie et al. | |
| 6,438,763 | B2 | 8/2002 | Guay et al. | |
| 6,701,535 | B2 * | 3/2004 | Dobbie et al. | 2/422 |
| 6,804,829 | B2 | 10/2004 | Crye et al. | |
| 6,834,398 | B1 * | 12/2004 | Martinez | 2/424 |
| 6,931,668 | B2 | 8/2005 | Dobbie et al. | |
| 6,961,963 | B2 | 11/2005 | Rosie | |
| 6,986,162 | B2 * | 1/2006 | Soto et al. | 2/6.3 |
| 7,159,249 | B2 | 1/2007 | Dennis et al. | |
| D548,893 | S | 8/2007 | Hedge et al. | |
| 7,299,505 | B2 | 11/2007 | Dennis et al. | |
| 7,805,776 | B2 * | 10/2010 | Crossman et al. | 2/424 |
| 2003/0070200 | A1 | 4/2003 | Crye et al. | |
| 2004/0156113 | A1 * | 8/2004 | Buchanan, Jr. | 359/630 |
| 2005/0166303 | A1 | 8/2005 | Aaron | |
| 2006/0064799 | A1 | 3/2006 | Dion | |
| 2006/0272067 | A1 * | 12/2006 | Gagnon et al. | 2/9 |

OTHER PUBLICATIONS

"Ballistic Protective Maxillofacial Shield", copyright 2007, Gentex Corporation, http://gentexcorp.com/default.aspx?pageid=1680, downloaded Mar. 16, 2008.

www.legionxxiv.org_equipment_pdf, "Legion XXIV Media Atlantia Equipment," Updated Oct. 23, 2003, downloaded Mar. 14, 2008.

http://en.wikipedia.org/wiki/Spangenhelm "Spangenhelm" Last edited Mar. 2, 2008, downloaded Mar. 14, 2008.

http://www.med-eng.com/products/force/cpe-pg4.html "Cupola Protective Ensemble (CPE)", © 2007 Meg-Eng Systems Inc., downloaded Mar. 17, 2008.

http://www.cryeassociates.com/09.html# "Product: Functional Objective Force Warrior helmet prototype", Crye Associates, downloaded Mar. 17, 2008.

U.S. Appl. No. 60/864,362.

U.S. Appl. No. 11/934,269.

* cited by examiner

FIG. 7
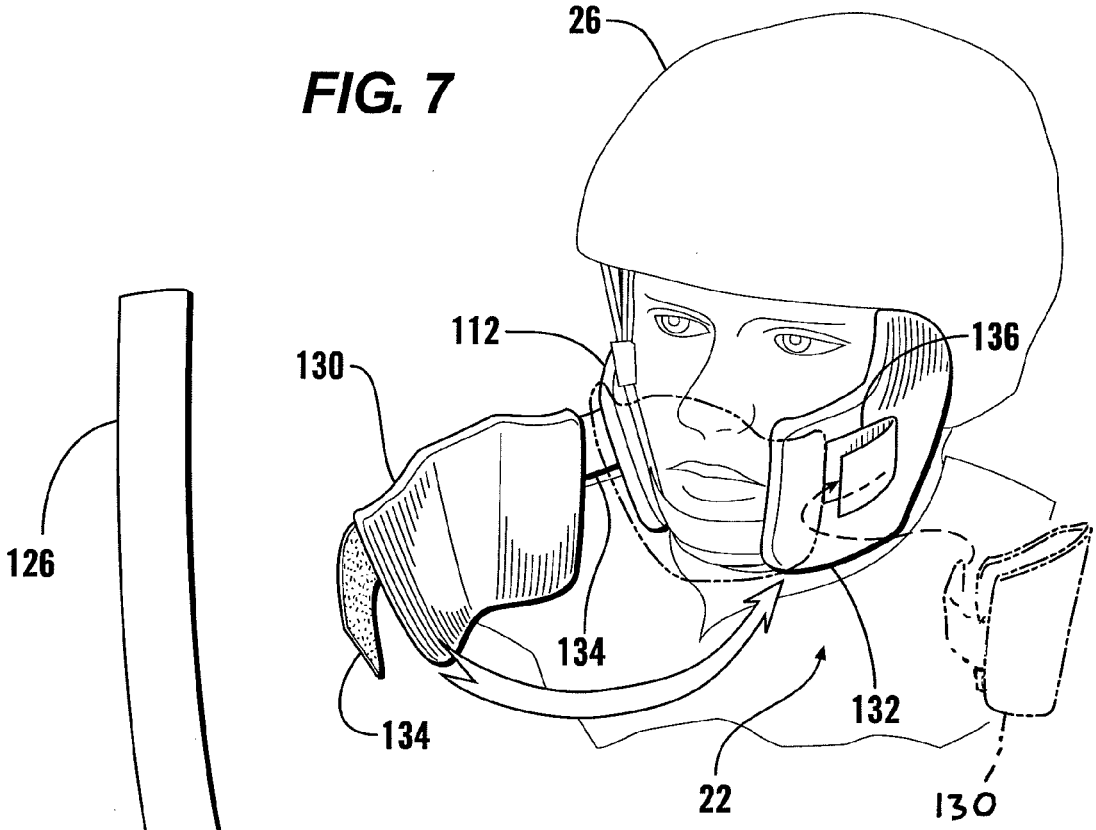
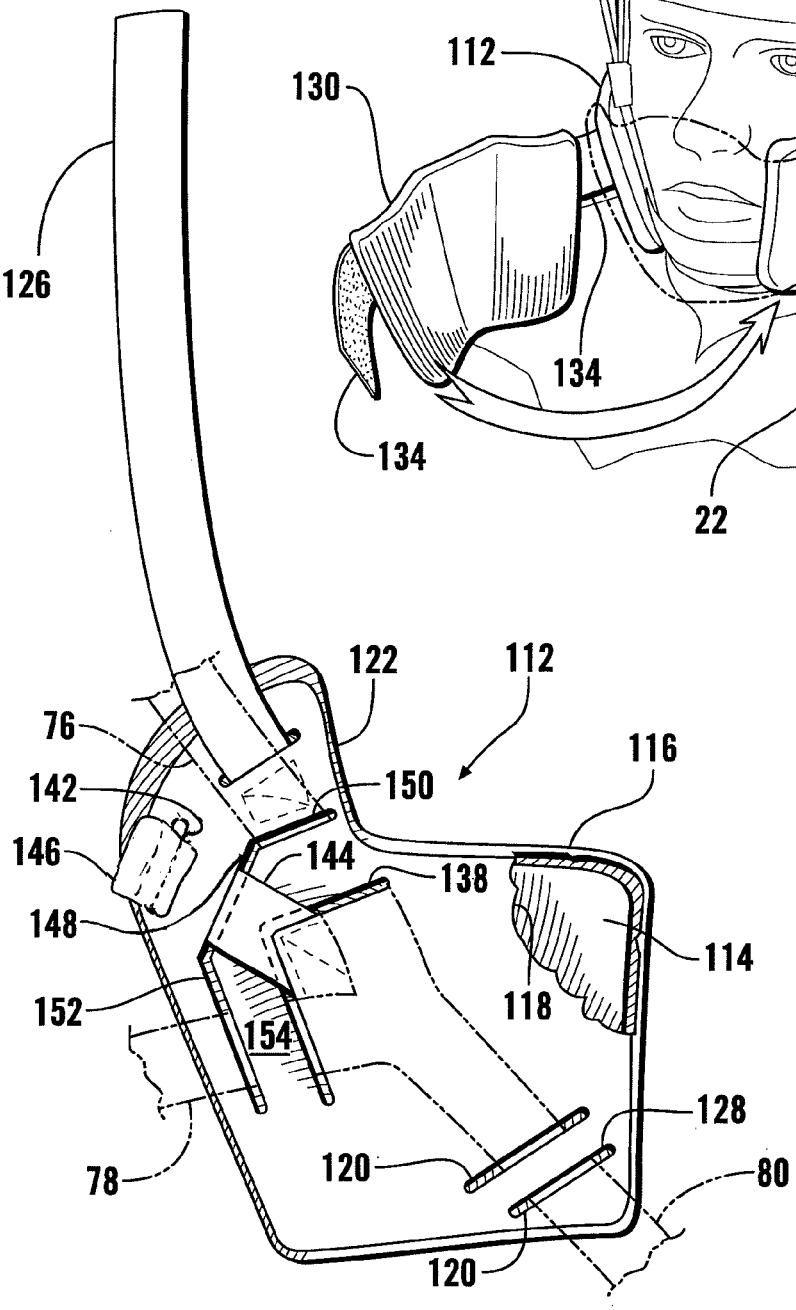
FIG. 6

FACE ARMOR

CROSS REFERENCES TO RELATED APPLICATIONS

This application claims the benefit of U.S. provisional App. No. 60/895,654 filed Mar. 19, 2007, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to protective headgear in general, and more particularly to ballistic armor for protecting portions of the wearer's face.

Penetrating head trauma as the result of projectiles striking the head are among the most severe hazards faced by soldiers and police officers. Such injuries are very often fatal, and where not can cause lasting disability. Metal and leather helmets for protection against bladed and lower velocity projectile weapons have been known since ancient times. The Roman legions employed bronze helmets with cheek guards provided with leather padding. In modern times lightweight helmets have been fabricated from ballistic materials such as Kevlar® phenolic resin treated aramid fabric. Most standard issue combat helmets, such as the U.S. Army Personnel Armor System Ground Troops (PASGT) Helmet, cover the top, rear, and sides of the head, but leave the face of the wearer unprotected.

Protection for the face has been provided by a large clear bullet-resistant shield or visor mounted to the helmet shell, or other stiff member which wraps around the face. While good for some applications, this solution can be too heavy and cumbersome for the average infantryman. Some of these devices can keep the wearer from being able to correctly sight his weapon by not allowing him to position his head and face in very close proximity with his rifle. Additionally face armor may cover the entire face with a single protective item. There are numerous times when covering the mouth and nose of a soldier is unacceptable, for instance when eating, drinking, or communicating.

What is needed is face armor that can be mounted to conventional helmets, yet which preserves access to the face as needed for particular tasks.

SUMMARY OF THE INVENTION

A specific arrangement of ballistic material shaped to cover portions of the wearer's face is configured to selectively attach to a ballistic helmet. This arrangement protects otherwise exposed areas of the wearer's head. A shape of ballistic material, which may be soft armor, hard armor, or a combination thereof, is attached to each side of the helmet, one right and one left. These shapes cover the sides of the wearer's head, but leave room to avoid interfering with hearing needs and eye protection devices such as goggles. These shapes are held in place by connecting them to the existing helmet shell or to the straps and hardware of the helmet, retention system. A removable piece of ballistic material may be used to join the left and right pieces and thereby cover a significant portion of the wearer's face. The ballistic material may be conventional soft armor, i.e., assemblies of ballistic fabric such as those formed from DuPont Kevlar® fibers, fibers of Spectra® ultra high molecular weight polyethylene fibers from Honeywell, or other ballistic material, or hard armor, for example elements fabricated of rigid plates of ceramic, polymer, or metal, or a combination of hard and soft armor.

It is an object of the present invention to provide face armor which readily and easily attaches to helmets already in the field, without modification to the helmets.

It is another object of the present invention to provide face armor which protects a significant portion of the head from projectiles, while allowing normal sighting of a weapon.

It is also an object of the present invention to provide face armor which protects a significant portion of the head from projectiles, while allowing the wearer to talk, drink, and communicate.

Further objects, features and advantages of the invention will be apparent from the following detailed description when taken in conjunction with the accompanying drawings.

BRIEF DESCRIPTION OF THE DRAWINGS

FIG. 6 is a side elevational view, partially broken away in section, of a left side element of another alternative embodiment face armor assembly of this invention with straps of a helmet retention assembly shown in phantom view.

FIG. 7 is a front perspective view of yet another alternative embodiment face armor assembly of this invention having a removable front panel.

DESCRIPTION OF THE PREFERRED EMBODIMENTS

Figure 1:
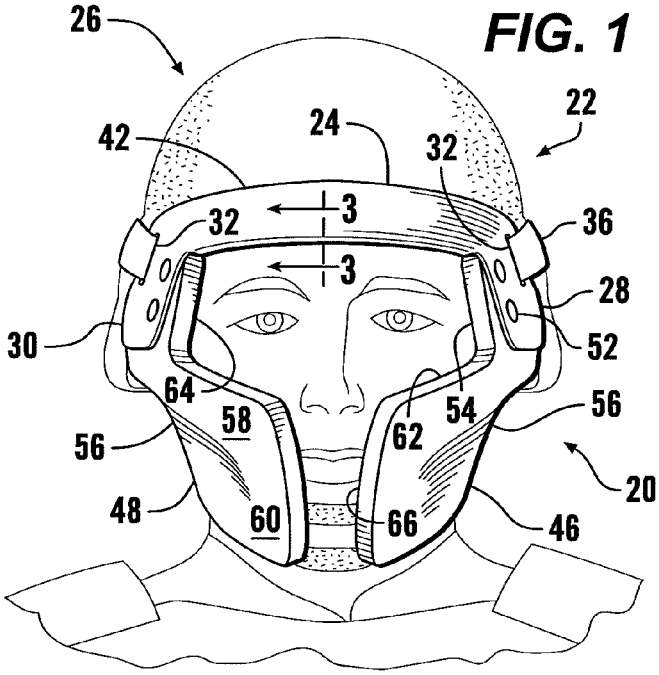
FIG. 1 is a front perspective view of a ballistic face armor assembly of this invention as worn by a soldier.

Referring more particularly to FIGS. 1-7, wherein like numbers refer to similar parts, a ballistic face armor assembly 20 is shown in FIG. 1 as worn by a soldier 22. The face armor assembly 20 has a rearwardly opening concave front band 24, best shown in FIGS. 2 and 4. The band 24 extends about half-way around a conventional helmet 26, for example a U.S. Army PASGT helmet, and has a first mounting flange 28 at one end, and a second mounting flange 30 at the other end. A one-and-a-quarter inch long, by one-eighth-inch wide slot 32 is formed in both ends, tilted from the vertical. An elastic 1-inch tall strap 36 is looped through the slots 32 at each end of the band 24, and is adjusted in length by the buckles 34. The strap 36 together with the front band 24 defines an encircling loop which is configured to encircle the shell 38 of the helmet 26.

Figure 3:
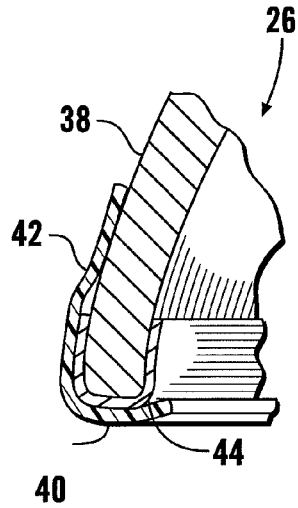
FIG. 3 is a cross-sectional view of the face armor assembly of FIG. 1, taken along section line 3-3.
Figure 2:
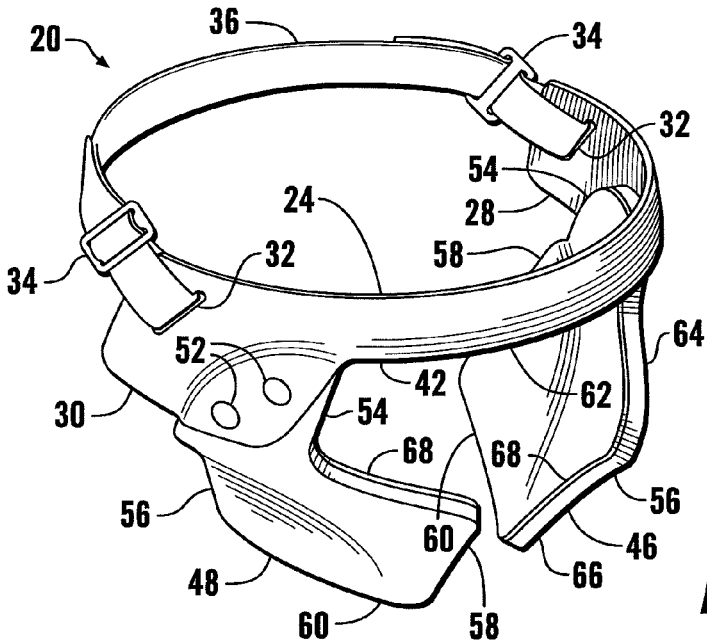
FIG. 2 is an isometric view of the face armor assembly of FIG. 1.

The front band 24 may be thermoformed or injection molded plastic, and need not be a ballistic element, because it extends for the most part over the ballistic shell 38 of the helmet 26. The band 24 may be formed of sheet material about ⅛ inches thick. The front band 24 brow segment 42 above the wearer's face is about one-inch tall, and has a rearwardly extending lip 40 which extends rearwardly about ⅜ of an inch, as best shown in FIG. 3. The lip 40 extends beneath the lower edge 44 of the helmet shell 38, and thereby prevents the face armor assembly 20 from riding upwardly on the helmet 26.

Figure 4:
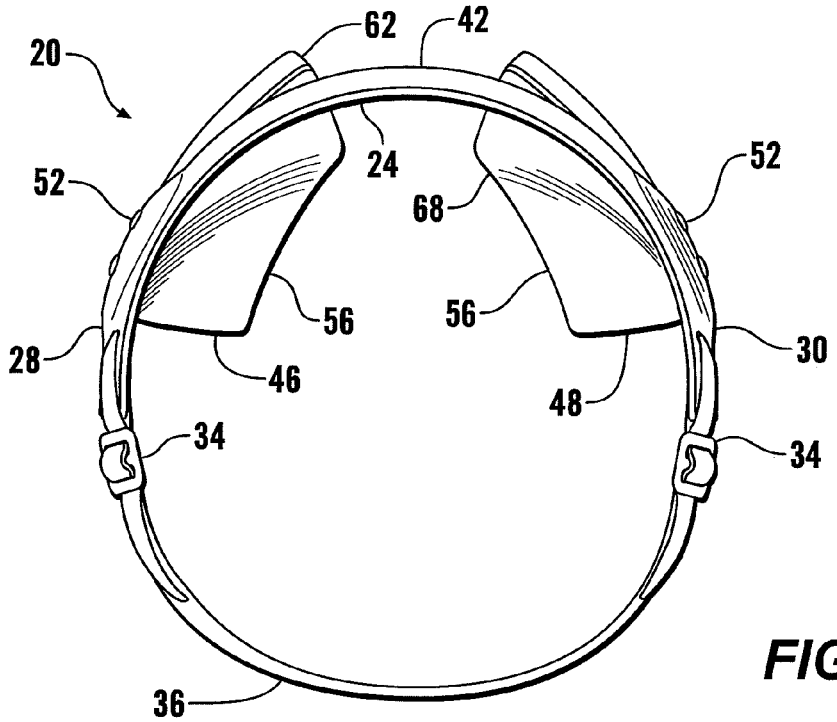
FIG. 4 is a top plan view of the ballistic face armor assembly of FIG. 1.

The ballistic protection is provided to the wearer's face by two porkchop-shaped side elements 46, 48 which are affixed to the downwardly extending mounting flanges 28, 30 of the front band 24, for example by two plastic rivets 52 at each side of the front band. As shown in FIG. 1, each side element 46, 48 has a vertical segment 54 which is fastened to a mounting flange, and a horizontal segment 56 which extends downwardly and frontwardly. As shown in FIG. 4, each side element 46, 48 is preferably curved about a generally vertical axis, so that the side elements wrap around the wearer's face. Each horizontal segment 56 has an upper portion 58 and a lower portion 60 which is recessed inwardly somewhat from the upper portion. This recessing allows the horizontal segments 56 to follow the shape of the wearer's face, and allows the wearer to shoulder a rifle stock in a conventional fashion, to sight the rifle in the normal manner.

The side elements 46, 48 are thus spaced opposite each other on either side of the front band, and are thus positioned to protect portions of the face of the wearer of the face armor assembly 20. A T-shaped opening 62 is thus defined in the front of face armor assembly between the two side elements 46, 48 and beneath the front band 24. An eye opening 64 is defined between the vertical segments 54 and above the horizontal segments 56. The eye opening 64 is preferably sized to allow the wearer of the armor to comfortably wear conventional goggles or other protective eyewear. A central opening 66 is defined below the eye opening 64 and between the forward edges of the two side element horizontal segments 56. This central opening 66 provides the wearer access to his mouth to permit eating and drinking while wearing the face armor.

The side elements 46, 48 are ballistic armor, preferably formed as an assembly of a plurality of layers of ballistic fabric, such as those formed from DuPont Kevlar® fibers or of Spectra® ultra high molecular weight polyethylene fibers from Honeywell. It is desirable that the side elements be generally rigid, so that they stay in the desired protective position with respect to the wearer's face. The side elements are approximately one-half inch thick, and are fabricated by cutting multiple layers of the ballistic fabric into the desired shape, and then subjecting the cut fabric layers, which are impregnated with a resin, to high pressures, about 45 tons, and a temperature of about 250 degrees Fahrenheit. The pressure is applied over a form to give the element the desired three-dimensional shape. The resultant element can then be cut on a bandsaw to the desired perimeter, and is preferably coated, for example, with a polyurethane material to protect the edges of the material.

Because the side elements 46, 48, can come repeatedly into contact with the wearer's face, the inwardly facing surfaces of the side elements may have a soft or resilient sheet 68 adhered thereto, for example a rubbery sheet, or a synthetic material such as duPont Hypalon® chlorosulfonated polyethylene.

The face armor assembly 20 may thus be used with conventional helmets, without regard to the helmet retention system of the conventional helmet. It may very rapidly be applied to the helmet, and removed. In an alternative embodiment, not shown, the front band and the side elements can be injection molded of ballistic material such as transparent polycarbonate plastic as a unitary element, to be mounted to a conventional helmet by a similar elastic strap as in the assembly 20. It should be noted that alternatively, the front band may be a strap of webbing held in tension.

Figure 5:
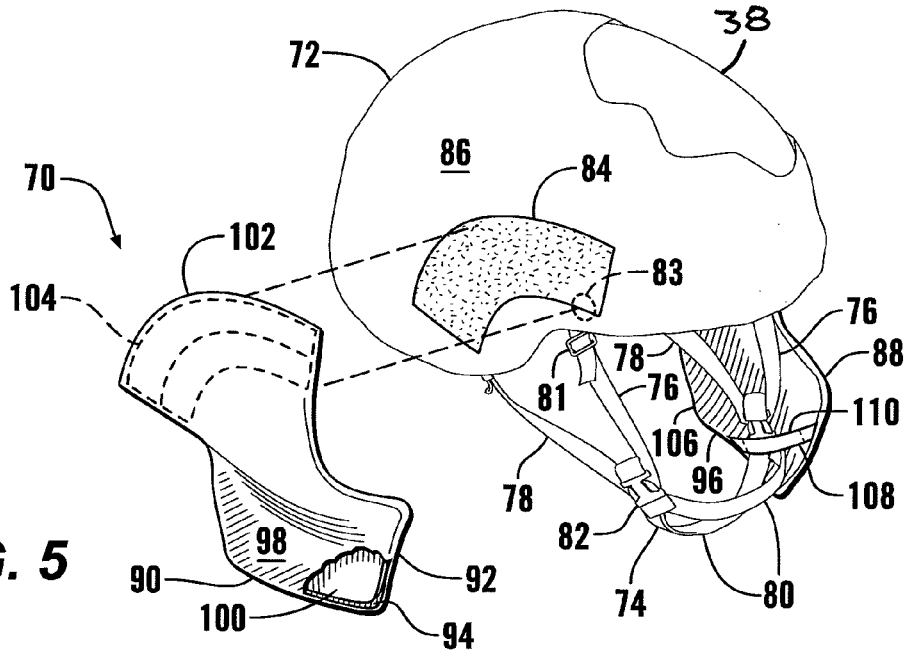
FIG. 5 is an exploded perspective view of an alternative embodiment ballistic face armor assembly of this invention shown attached to a conventional helmet, with a helmet cover shown partially broken away in section.

An alternative embodiment face armor assembly 70 is shown in FIG. 5. The face armor assembly 70 includes a flexible fabric helmet cover 72 which encircles portions of the helmet shell 38 of a conventional helmet 26 and is attached to the shell in a conventional fashion, for example by an elastic lower band, by snap or hook-and-loop fastener straps, etc. The helmet 26 has a conventional helmet retention assembly 74 comprised of a number of adjustable straps which secure the helmet to the wearer's head. The retention assembly 74 has two front straps 76 which extend downwardly from the sides of the helmet, and which are joined to nape straps 78 which extend rearwardly to extend around the sides of the wearer's head and which are connected to rear straps which are connected to the rear of the helmet. The front straps 76 and the nape straps 78 are connected by chin straps 80 which extend from a buckle 82 which allows the quick release of the helmet from the wearer. The front straps 76 extend downwardly from adjustment buckles 81 which are connected by short straps, not shown, to fasteners 83 engaged with the helmet shell.

The helmet cover 72 is provided with attachment patches 84 of one part of a two-part hook-and-loop fastener material such as VELCRO fastener manufactured by Velcro Industries B.V. The attachment patches 84 may be curved strips of material fixed to the outwardly facing surface 86 of the cover on opposite sides of the helmet.

The attachment patches serve to mount two side elements 88, 90 to the helmet cover. Each side element 88, 90 is comprised of a flexible fabric bag 92 or pouch which has an interior compartment 94 formed between an inner sheet 96 and an outer sheet 98 sewn together. A shaped ballistic element 100 is contained within the compartment 94. The ballistic element 100 may be conventional soft armor, for example a multiplicity of layers of ballistic fabric glued together and formed under pressure into the desired shape. The ballistic fabric sheets may also be co-formed with a plastic sheet stiffening layer of nylon, polyethylene, or a thermoplastic material, such as is disclosed in U.S. Pat. No. 6,892,392, the disclosure of which is incorporated by reference herein.

The fabric bag 92 has a wing 102 which extends upwardly from the ballistic element 100, and an attachment patch 104 is sewn to an inwardly facing surface 106 of the inner sheet 96 on the wing. The attachment patch 104 is the other part of the two-part hook-and-loop fastener to mate with the attachment patch 84 on the cover 72. The side elements may thus be removably engaged with the helmet cover.

To restrict the displacement of the side elements with respect to the helmet shell, each side element 88, 90, has a loop 108 defined by a strip of webbing 110 which is sewn to the inner sheet 96 of the fabric bag 92 in the lower forward corner. Each loop 108 is positioned to receive a portion of a front strap 76 which extends downwardly from the helmet assembly. Because the front straps are secured to the wearer's head, the engagement of the ballistic elements with the front straps serves to position the side elements for protection of portions of the face of a person wearing the helmet assembly.

The shape of the side elements 88, 90 where they project from the helmet may be generally similar to the shapes of the side elements 46, 48, of the face armor assembly 20. Thus each side element has a vertical segment and a horizontal segment which extends downwardly and frontwardly, and is preferably curved about a generally vertical axis, so that the side elements wrap around the wearer's face. Each horizontal segment has an upper portion and a lower portion which is recessed inwardly somewhat from the upper portion.

It should be noted that the helmet cover attachment patches 84 may be supplied sewn to a helmet cover, or alternatively, the mounting patches may have a high-strength adhesive backing with a peel-off release layer, thereby allowing the mounting patches to be attached to pre-existing helmet covers in the field. Moreover, the fabric bag, rather then being sewn from sheets of fabric, may be fabricated of compression molded foam pieces on one or both sides of the ballistic element.

An alternative embodiment side element 112 of another alternative embodiment face armor assembly is shown in FIG. 6. The side element 112 is a side element to be mounted to the left side of a wearer's face. A similar, but mirror image, side element may be mounted to provide protection for the right side of a wearer's face. The side element 112 is intended for attachment to a conventional helmet assembly with helmet retention system such as the one illustrated in FIG. 5.

The side element 112 has a shaped ballistic element 114 enclosed within a bag, or otherwise surrounded by a protective covering, such as by gluing a piece of fabric 116 to the exterior of the ballistic element, and a cut sheet of rubber-like material 118 to the interior. The fabric 116 and material 118 define a compartment within an enclosure for the ballistic element. The ballistic element 114 is preferably an assembly of layers of ballistic material in soft armor as described above, but may also be a hard armor element. The side element 112 has a vertical segment 122 which extends downwardly and a horizontal segment 124 which extends downwardly and frontwardly. The entire side element 112 is preferably curved about a generally vertical axis, so that the side element wraps around the wearer's face. As with the above embodiments, the side element 112 may be formed such that the horizontal segment has an upper portion and a lower portion which is recessed inwardly somewhat from the upper portion, to conform more closely to the wearer's face and to allow a rifle to be brought closer to a wearer's face.

A flexible strap 126 is fixed to the sheet of material 118. The strap 126 may be a conventional strip of webbing which extends upwardly from the vertical segment of the side element 112. By threading the strap 126 through the adjustment buckle 81 on the helmet shell 38, the side element is connected to the conventional helmet assembly 26 and positioned at the appropriate height with respect to the wearer's face. The side element is configured for mounting to the retention assembly 74 of the conventional helmet. An inverted L-shaped slot 138 is positioned generally in the middle of the sheet 118, and a three-sided slot 140 is positioned above and rearwardly of the inverted L-shaped slot 138, defining a middle segment 154 of the sheet between the L-shaped slot and the three-sided slot. A short securement slot 142 is positioned above and rearward of the three-sided slot 140. A securement tab 144 is sewn to the sheet 118 to extend upwardly from the inverted L-shaped slot 138. The securement tab 144 is a strip of elastic webbing which is folded over and sewn at its far end to define a catch 146. The securement tab 144 may be passed through a central segment 148 of the three-sided slot 140 and out the securement slot 142, such that the catch 146 engages in the securement slot. Two slots 120 are formed in the lower forward corner of the horizontal segment 124 which are spaced from one another to define a loop 128 which receives a portion of a chin strap 80.

To mount the side element 112 to the retention assembly, the chin strap 80 is passed through the three-sided slot 140 and then out through the inverted L-shaped slot 138, over the surface of the sheet 118, and through the loop 128. The side element 112 is positioned such that the front strap 76 extends upwardly through the upper segment 150 of the three-side slot 140, and the nape strap 78 extends rearwardly through the lower segment 152 of the three-sided slot. The securement tab 144 is then engaged in the securement slot 142, which serves to prevent the release of the front strap 76 and the nape strap 78 from the element, and to thereby retain the side element in place. The sheet 118 is attached to the fabric 116 or to the ballistic element in such a way that the sheet is free from the ballistic element where necessary to allow the straps of the retention assembly to pass beneath the sheet 118.

For additional ballistic protection, a front element 130, as shown in FIG. 7, may be removably mounted between the two side elements 112, 132. The front element 130 may have a single ballistic element retained within an enclosing bag, but preferably has multiple ballistic elements, to permit the front element 130 to be hinged and folded to the side. The front element 130 has side straps 134 which have hook-and-loop fastener which releasably engages with compatible hook-and-loop fastener attachment patches 136 on the exteriors of the side elements 112, 132. The patches 136 on the side elements may be in the form of straps which engage with the front element side straps 134 on two surfaces to give a more secure attachment. The front element 130 may thus be entirely removed from the face armor assembly, or may be folded to either side and stored in a folded condition on whichever side element is desired. The front element 130 may be provided with various patches of hook and loop fastener, not shown, to permit it to be retained in a folded stored configuration on either of the side elements. A similar front element may also be mounted to the other face armor assemblies 20, 70.

It should be noted that a helmet strap kit could be constructed with the armored portion at time of manufacture and would not require the ability to be "added on" to an existing helmet retention system.

It should be noted that in place of the front band and strap shown in FIG. 1 in the face armor 20, which serve as a connector to the helmet, alternatively the front band can be provided with bolt openings which permit the front band to be mounted to a conventional helmet shell, such as is shown in FIG. 5, which is typically provided with bolts 83 which attach the helmet retention assembly to the helmet shell, by engagement of the holes in the band with the preexisting bolts. Thus to mount the face armor to the helmet, existing bolts are removed and passed through the openings in the front band, and reinserted. In such a case no strap is required.

It is understood that the invention is not limited to the particular construction and arrangement of parts herein illustrated and described, but embraces all such modified forms thereof as come within the scope of the following claims.

I claim:

1. A face armor assembly for attachment to a stiff helmet shell, the face armor assembly comprising:

a concave, rearwardly opening front band, the band having a first end and a second end;

a strap which extends between the first end and the second end of the front band, the strap and the band defining an encircling loop configured to encircle the helmet shell;

a first side element fixed to the front band; and a second side element fixed to the front band, and spaced from the first side element to be positioned opposite the first side element, to be positioned to protect portions of a face of a person wearing a helmet to which the face armor assembly is mounted, wherein both the first side element and the second side element are comprised of a vertical segment which extends downwardly from the front band, and a horizontal segment which extends downwardly and frontwardly from the vertical segment, the horizontal segments positioned to extend below the level of the nose of a wearer of the face armor assembly, and the horizontal segments being comprised of a ballistic material selected from the group consisting of: fabric of aramid fibers, fabric of ultra high molecular weight polyethylene fibers, and rigid plates of metal.

2. The face armor assembly of claim 1, wherein a gap is defined between the first side element and the second side element where the wearer's face is unobstructed.

3. The face armor assembly of claim 1 further comprising a front element, the front element extending between the first side element and the second side element, and being releasably connected to both the first side element and the second side element, the front element comprising a ballistic element.

4. The face armor assembly of claim 1 wherein the front band has a brow segment positioned between the first end and the second end, and wherein a lip extends rearwardly from the brow segment for engagement beneath a lower edge of the helmet shell to limit the upward displacement of the face armor assembly with respect to the helmet shell.

5. A face armor and helmet assembly comprising:

a stiff helmet shell;

a face armor assembly comprising:

a concave, rearwardly opening front band which extends over the helmet shell above a face of a wearer of the helmet, the band having a first end and a second end;

a strap which extends between the first end and the second end of the front band, the strap and the band defining an encircling loop configured to encircle the helmet shell;

a first side element extending downwardly from the front band; and a second side element extending downwardly from the front band, and spaced from the first side element to be positioned opposite the first side element, to be positioned to protect portions of a face of a person wearing the helmet to which the face armor assembly is mounted, wherein both the first side element and the second side element are comprised of a vertical segment which extends downwardly from the front band, and a horizontal segment which extends downwardly and frontwardly from the vertical segment, the horizontal segment being positioned to extend below the level of the nose of a wearer of the face armor and helmet assembly, wherein an opening is defined between the first side element and the second side element and beneath the front band, the opening providing the wearer access to the wearer's mouth to permit eating and drinking while wearing the face armor assembly, wherein the first side element and the second side element comprise a ballistic material selected from the group consisting of: fabric of aramid fibers, fabric of ultra high molecular weight polyethylene fibers, and rigid plates of metal.

6. The face armor assembly of claim 5, wherein the opening comprises an eye opening between the vertical segments of the first side element and the second side element, the eye opening being above the horizontal segments.

7. The face armor assembly of claim 5 wherein the front band has a brow segment positioned between the first end and the second end, and wherein a lip extends rearwardly from the brow segment for engagement beneath a lower edge of the helmet shell to limit the upward displacement of the face armor assembly with respect to the helmet shell.

8. A face armor assembly for attachment to a stiff helmet shell, the face armor assembly comprising:

a concave, rearwardly opening front band, the band extending above a wearer's eyes and having a first end and a second end;

a connector which extends from the front band to engage the helmet shell;

a first side element fixed to the front band; and a second side element fixed to the front band, and spaced from the first side element to be positioned opposite the first side element, to be positioned to protect portions of a face of a person wearing a helmet to which the face armor assembly is mounted, wherein both the first side element and the second side element are comprised of a vertical segment which extends downwardly from the front band, and a horizontal segment which extends downwardly and frontwardly from the vertical segment, the horizontal segments extending to a position beneath the pupils of the wearer's eyes and being comprised of ballistic material, wherein the ballistic material is selected from the group consisting of: fabric of aramid fibers, fabric of ultra high molecular weight polyethylene fibers, and rigid plates of metal.

9. The face armor assembly of claim 1 wherein the side element horizontal segments are positioned to extend to a position beneath the pupils of the wearer's eyes.

10. The face armor assembly of claim 9 wherein the side elements extend to a position to overlie a portion of the wearer's mouth.

11. The face armor assembly of claim 1 wherein the side elements comprise a plurality of layers of ballistic material.

12. The face armor assembly of claim 1 wherein each side element is curved about a generally vertical axis so as to wrap around a wearer's face.

13. The face armor assembly of claim 1 wherein the first side element horizontal segment has an upper portion and a lower portion which is recessed inwardly from the upper portion.

14. The face armor assembly of claim 1 wherein portions of the horizontal segments project frontwardly of the front band.

15. The face armor and helmet assembly of claim 5 wherein the side element horizontal segments are positioned to extend to a position beneath the pupils of the wearer's eyes.

16. The face armor and helmet assembly of claim 15 wherein the side elements extend to a position to overlie a portion of the wearer's mouth.

17. The face armor and helmet assembly of claim 5 wherein the side elements comprise a plurality of layers of ballistic material.

18. The face armor and helmet assembly of claim 5 wherein each side element is curved about a generally vertical axis so as to wrap around a wearer's face.

19. The face armor and helmet assembly of claim 5 wherein the first side element horizontal segment has an upper portion and a lower portion which is recessed inwardly from the upper portion.

20. The face armor and helmet assembly of claim 5 wherein portions of the horizontal segments project frontwardly of the front band.

21. A face armor and helmet assembly, comprising:

a helmet having a stiff helmet shell with a front lower edge;

a concave, rearwardly opening front band, the band having a first end and a second end, and a brow segment positioned therebetween, the brow segment having a lower edge;

a lip which extends rearwardly from the brow segment lower edge to engage beneath the lower edge of the helmet shell to limit the upward displacement of the front band with respect to the helmet shell;

a strap which extends between the first end and the second end of the front band, the strap and the band encircling the helmet shell;

a first side element fixed to the front band; and a second side element fixed to the front band, and spaced from the first side element to be positioned opposite the first side element, to be positioned to protect portions of a face of a person wearing the face armor and helmet assembly, wherein both the first side element and the second side element are comprised of a vertical segment which extends downwardly from the front band, and a horizontal segment which extends downwardly and frontwardly from the vertical segment, the horizontal segments positioned to extend below the level of the mouth of the person wearing the face armor and helmet assembly, the horizontal segments being comprised of a ballistic material.

* * * * *